United States Patent [19]

Favre

[11] Patent Number: 4,917,251

[45] Date of Patent: Apr. 17, 1990

[54] CONTAINER FOR PROVIDING FROTHY BEVERAGES

[75] Inventor: Eric Favre, Saint-Barthelemy, Switzerland

[73] Assignee: Nestec S.A., Vevey, Switzerland

[21] Appl. No.: 206,311

[22] Filed: Jun. 14, 1988

[30] Foreign Application Priority Data

Jul. 3, 1987 [CH] Switzerland ..... 2541/87

[51] Int. Cl.[4] ..... A47G 19/22; A47G 19/23

[52] U.S. Cl. ..... 215/1 R; 215/10; 229/1.5 B; 426/519

[58] Field of Search ..... 215/1 R, 10; 229/1.5 B; D7/6, 9, 15; 99/279, 293, 300–323; 426/474, 312, 433, 519

[56] References Cited

U.S. PATENT DOCUMENTS

| | | | |
|---|---|---|---|
| D. 98,614 | 2/1936 | Prouty | D7/15 |
| D. 153,432 | 4/1949 | Heisey | D7/15 |
| D. 167,917 | 10/1952 | Wagner | D7/9 |
| D. 188,802 | 9/1960 | Miller | D7/9 |
| D. 203,402 | 1/1966 | Wiinblad | D7/9 |
| D. 228,330 | 9/1973 | Bright | D7/15 |
| D. 237,574 | 11/1975 | Goertzen | D7/6 |
| D. 285,516 | 9/1986 | Miller | D7/9 |
| 1,657,664 | 1/1928 | Dexter | D7/9 X |
| 2,142,811 | 1/1939 | Agonis | 215/1 R |
| 4,108,904 | 4/1977 | Muroaka | 229/1.5 B X |

FOREIGN PATENT DOCUMENTS

| | | | |
|---|---|---|---|
| 643897 | 7/1962 | Canada | 215/1 R |
| 178147 | 11/1905 | Fed. Rep. of Germany | D7/9 |
| 2301805 | 7/1974 | Fed. Rep. of Germany | 215/1 R |
| 431414 | 11/1911 | France | 215/1 R |

OTHER PUBLICATIONS

"Thermal Drinking Vessel", from Industrial Design Magazine, Mar./Apr. 1982, p. 49.

"New Mold For Fostoria:" from Industrial Design, Jan. 1958, p. 60.

*Primary Examiner*—Sue A. Weaver

*Attorney, Agent, or Firm*—Vogt & O'Donnell

[57] ABSTRACT

A container for beverages, particularly beverages, such as coffee, which form a froth upon being dispensed in the container for consumption, has an interior base portion extending to a sidewall portion and defining an interior beverage containing surface having a shape in the form of an ellipsoid of revolution having an eccentricity of from 1.15 to 5.0, a hyperboloid of revolution having asymptotes forming an angle of less than 90°, or a paraboloid of revolution wherein a distance from a focus of the parabola to its directrix line is from 0.5 to 3.0 for promoting the formation of a shell of froth when the beverage is dispensed into the cup.

12 Claims, 1 Drawing Sheet

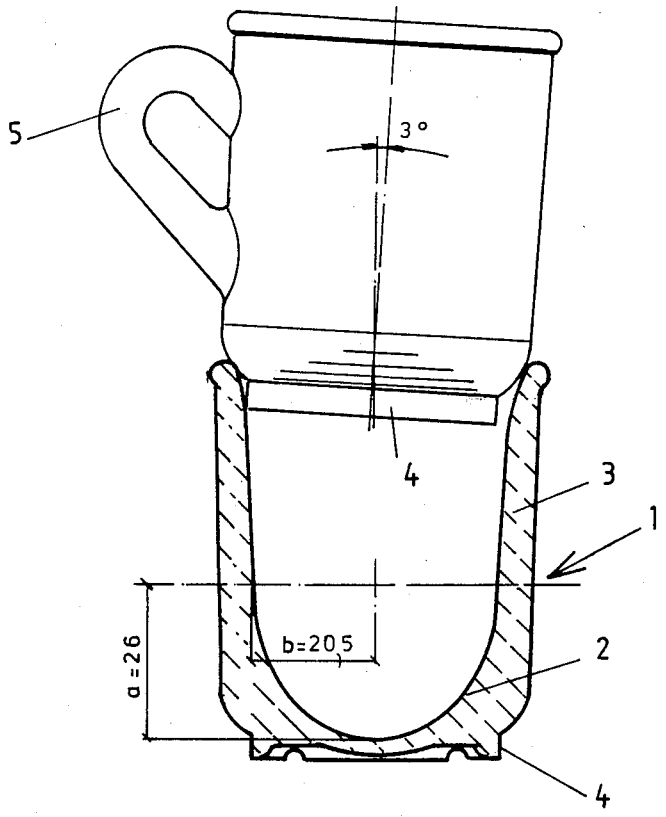
Fig.

CONTAINER FOR PROVIDING FROTHY BEVERAGES

BACKGROUND OF THE INVENTION

This invention relates to a container for beverages, particularly espresso coffee, comprising a base and a side wall.

Hitherto, it has been customary to serve a beverage, such as coffee, in flat-bottomed cups. However, recent tests with experts on coffee, particularly espresso coffee, have shown that it is possible to prepare a coffee having better characteristics in regard to taste and persistence of the coffee impression, providing the coffee is prepared in a container which does not have a flat bottom.

SUMMARY OF THE INVENTION

The object of the present invention is to place at the disposal of the consumer a container for the preparation of a beverage, particularly espresso coffee, in which all the characteristics of a good coffee are developed.

Accordingly, the present invention relates to a container for beverages comprising a base and a side wall in which the base is in the form of an ellipsoid of resolution, a paraboloid of revolution or a hyperboloid of revolution.

By ellipsoid of revolution is meant the surface generated by the rotation of an ellipse about its major axis. It is obvious that the base of the container has substantially the shape of the resulting semi-ellipsoid.

A paraboloid of revolution is understood, on the basis of the parabola satisfying the equation $y^2=2$ px, p being the distance from the focus of the parabola to the directrix line, to be the surface generated by the rotation of a parabola about the x axis.

A hyperboloid of revolution is understood to be surface generated by the rotation of a hyperbola satisfying the equation $xy=k$ about the bissectrix of the asymptotes, k being a number of from greater than 0 to 3.

Tasting tests have shown that the coffee is better, the closer the shape of the base is to an ellipsoid having an eccentricity of greater than 1.15. By eccentricity is meant the ratio between the major and the minor axes. The base of the container preferably has an eccentricity of from 1.15 to 5.

DETAILED DESCRIPTION OF THE INVENTION

The containers of the present invention are particularly intended for the preparation of espresso coffee. As espresso coffee is a mixture of water, coffee, coffee oil and air, the special shape of the base promotes the formation of a shell of froth which reduces deaeration of the coffee and promotes the quality of espresso, namely lightness, fineness and persistence of the coffee taste.

If the base of the container is a hyperboloid, it is selected so that its asymptotes form an angle of less than 90° and preferably between 60 and 30°.

If the base is a paraboloid, it is selected with a parameter p of from 0.5 to 3.

It is obvious that this shape of the base only extends to substantially half the height of the container. In this case, the inner upper part of the container is substantially cylindrical or slightly frustoconical in shape.

The capacity of the container according to the invention varies from 30 to 250 $cm^3$ and preferably between 50 and 100 $cm^3$.

The material used to make the container according to the invention may be of any type providing it is compatible in the food field.

With containers for beverages, it is always of advantage if they can be stacked on top of one another. The problem is to prevent the containers from tilting. To obtain stacking containers having an inclination of no more than 5°, a bottom between 3 and 10 mm tall is provided on the container. This minimizes the risks of tilting where more than 3 cups are stacked.

BRIEF DESCRIPTION OF THE DRAWING

The invention is described in more detail with reference to the accompanying drawing which is a partial section through a container according to the invention on which a second container has been stacked.

DETAILED DESCRIPTION OF THE DRAWING

The container (1) comprises a base (2) and a side wall (3). In this case, the base is in the form of an ellipsoid with a half major axis of 26 mm and a half minor axis of 20.5 mm, which gives an eccentricity of 1.27. The stacked container has a handle (5) and a bottom (4) 5 mm tall. A stack having an inclination of 3° is thus formed. The side wall (3) is slightly frustoconical in shape, i.e., it forms an angle of 3° towards the outside with the axis of symmetry of the container.

I claim:

1. A container for improving formation of a surface froth of beverages dispensed therein comprising an interior base portion extending to a sidewall portion, each portion defining an interior beverage containing surface, the base portion having a shape of an ellipsoid of revolution having an eccentricity of from 1.15 to 5.0.

2. A container according to claim 1 wherein the base extends to the sidewall to form substantially one-half a height of a height of the container.

3. A container according to claim 1 or 2 wherein the interior of the container has a volume of from 30 $cm^3$ to 250 $cm^3$.

4. A container according to claim 1 wherein the sidewall has a shape selected from a group consisting of a substantially cylindrical shape and a slightly frustoconical shape.

5. A process for improving formation of a surface froth of a beverage dispensed into a container comprising dispensing a beverage into a container interior having a base portion extending to a sidewall portion, each portion defining an interior beverage containing surface, the base having a shape of an ellipsoid of revolution having an eccentricity of from 1.15 to 5.0.

6. A process according to claim 5 wherein the base extends to the sidewall to form substantially one-half a height of a height of the container.

7. A process according to claim 5 or 6 wherein the interior of the container has a volume of from 30 $cm^3$ to 250 $cm^3$.

8. A process according to claim 5 wherein the sidewall has a shape selected from a group consisting of a substantially cylindrical shape and a slightly frustoconical shape.

9. A process according to claim 5 wherein the beverage is coffee.

10. A process according to claim 7 wherein the beverage is coffee.

11. A process according to claim 9 wherein the coffee is espresso coffee.

12. A process according to claim 10 wherein the coffee is espresso coffee.

* * * * *